US008988410B2

(12) United States Patent
Lee et al.

(10) Patent No.: US 8,988,410 B2
(45) Date of Patent: Mar. 24, 2015

(54) DISPLAY DEVICE AND METHOD OF OPERATING THE SAME

(75) Inventors: Kwangsae Lee, Yongin (KR); Jeonggeun Yoo, Yongin (KR); Sang-Min Lim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 571 days.

(21) Appl. No.: 13/200,331

(22) Filed: Sep. 23, 2011

(65) Prior Publication Data

US 2012/0242641 A1 Sep. 27, 2012

(30) Foreign Application Priority Data

Mar. 24, 2011 (KR) ..... 10-2011-0026559

(51) Int. Cl.
*G09G 5/00* (2006.01)
*G09G 3/36* (2006.01)

(52) U.S. Cl.
CPC ..... *G09G 3/3655* (2013.01)
USPC ..... 345/212; 345/204; 345/205; 345/207; 345/209; 345/211

(58) Field of Classification Search
CPC ..... G09G 5/00
USPC ..... 345/87–104, 204–212, 589, 690; 327/539; 341/155, 163
See application file for complete search history.

(56) References Cited

U.S. PATENT DOCUMENTS 6,229,510 B1 * 5/2001 Kim et al. ..... 345/87
6,317,109 B1 * 11/2001 Lee ..... 345/87
7,151,475 B2 * 12/2006 Boemler ..... 341/155
7,342,561 B2 3/2008 Hiraki et al.
8,022,916 B2 * 9/2011 Lee et al. ..... 345/94
8,525,765 B2 * 9/2013 Kim et al. ..... 345/89
8,553,051 B2 * 10/2013 Chen et al. ..... 345/690
2003/0151582 A1 * 8/2003 Ishii ..... 345/100
2006/0007249 A1 * 1/2006 Reddy et al. ..... 345/690
2007/0024560 A1 2/2007 Kim et al.
2008/0062105 A1 * 3/2008 Han et al. ..... 345/90
2008/0143703 A1 * 6/2008 Huang ..... 345/211
2008/0158218 A1 * 7/2008 Kim ..... 345/212
2008/0266276 A1 * 10/2008 Choi et al. ..... 345/204
2008/0303967 A1 * 12/2008 Huang et al. ..... 349/39
2009/0101900 A1 * 4/2009 Chuang et al. ..... 257/59
2009/0135124 A1 5/2009 Nakatsuka
2009/0167659 A1 * 7/2009 Kim et al. ..... 345/89
2009/0244109 A1 * 10/2009 Chen et al. ..... 345/690
2010/0201669 A1 * 8/2010 Kim et al. ..... 345/211
(Continued)

FOREIGN PATENT DOCUMENTS

CN 1908741 A 2/2007
EP 2065881 A2 6/2009
(Continued)

*Primary Examiner* — Prabodh M Dharia
(74) *Attorney, Agent, or Firm* — Lee & Morse, P.C.

(57) ABSTRACT

A display panel includes a display pixel displaying an image in response to a common voltage and a data voltage and a sensing pixel outputting a feedback voltage in response to the common voltage and a reference voltage; and a driving circuit unit supplying the data voltage and the reference voltage to the display pixel and the sensing pixel, respectively. The driving circuit unit includes a common voltage estimating part comparing the reference voltage and the feedback voltage to generate a counter signal having a counter value that is stepwise varied according to the comparing of the reference voltage and the feedback voltage; and a common voltage adjusting part stepwise varying the common voltage supplied to the display panel in response to the counter value.

18 Claims, 5 Drawing Sheets

(56) References Cited

U.S. PATENT DOCUMENTS

| | | | | |
|---|---|---|---|---|
| 2011/0102401 | A1* | 5/2011 | Feng | 345/211 |
| 2011/0141098 | A1* | 6/2011 | Yaguma et al. | 345/212 |
| 2011/0221983 | A1 | 9/2011 | Lee | |

FOREIGN PATENT DOCUMENTS

| | | | |
|---|---|---|---|
| JP | 2004-086146 | A | 3/2004 |
| JP | 2009-128825 | A | 6/2009 |
| KR | 10 1999-0010635 | A | 2/1999 |
| KR | 10 2004-0002746 | A | 1/2004 |
| KR | 10 2005-0050883 | A | 6/2005 |
| KR | 10 2005-0113477 | A | 12/2005 |
| KR | 10 2007-0015695 | A | 2/2007 |
| KR | 10 2008-0025115 | A | 3/2008 |
| KR | 10 2008-0034542 | A | 4/2008 |
| KR | 10-2011-0102673 | | 9/2011 |
| TW | I248057 | B | 1/2006 |

* cited by examiner

DISPLAY DEVICE AND METHOD OF OPERATING THE SAME

CROSS-REFERENCE TO RELATED APPLICATIONS

This application claims the benefits, under 35 U.S.C §119, of Korean Patent Application No. 10-2011-0026559 filed Mar. 24, 2011, the entirety of which is incorporated by reference herein.

BACKGROUND

1. Field

Exemplary embodiments relate to a display device, and more particularly, relate to a display device and its operating method.

2. Description of the Related Art

A liquid crystal display device may be a display device which obtains an image signal by adjusting the amount of light penetrating a substrate. The amount of light may be adjusted by controlling an electric field applied to a liquid crystal material injected between two substrates and having an anisotropic permittivity.

This liquid crystal display device may be a representative flat panel display device being easy to carry around. In particular, a thin film transistor (TFT) liquid crystal display device using thin film transistors as switching elements may be mainly used.

SUMMARY

One embodiments is directed to a display device which comprises a display panel including a display pixel displaying an image in response to a common voltage and a data voltage and a sensing pixel outputting a feedback voltage in response to the common voltage and a reference voltage; and a driving circuit unit supplying the data voltage and the reference voltage to the display pixel and the sensing pixel, respectively. The driving circuit unit comprises a common voltage estimating part comparing the reference voltage and the feedback voltage to generate a counter signal having a counter value that is stepwise varied according to the comparing of the reference voltage and the feedback voltage; and a common voltage adjusting part stepwise varying the common voltage supplied to the display panel in response to the counter value.

In this embodiment, the common voltage estimating part comprises a reference voltage generator generating the reference voltage and applying the reference voltage to the sensing pixel; a comparator generating a comparison signal by comparing the reference voltage and the feedback voltage; and a counter generating the counter signal having the counter value in response to the comparison signal.

In this embodiment, when the feedback voltage is lower in level than the reference voltage, the counter increases the counter value of the counter signal in response to the comparison signal, and the common voltage adjusting part increases the common voltage in response to the counter signal having the increased counter value.

In this embodiment, when the feedback voltage is higher in level than the reference voltage, the counter decreases the counter value of the counter signal in response to the comparison signal, and the common voltage adjusting part decreases the common voltage in response to the counter signal decreasing the counter value.

In this embodiment, the counter maintains the counter value of the counter signal when a difference between the reference voltage and the feedback voltage exists within a threshold value.

In this embodiment, the counter signal has an initial counter value, the counter signal having the initial counter value is supplied to the common voltage adjusting part before the comparison signal is generated by the comparator, and the common voltage adjusting part increases the common voltage in response to the counter signal having the initial counter value.

In this embodiment, the driving circuit unit further comprises a gate driving part supplying a gate voltage to the display pixel and the sensing pixel.

In this embodiment, the counter varies the counter value in a stepwise manner during a low level period of the gate voltage.

In this embodiment, the common voltage adjusting part further comprises a first amplifier amplifying the feedback voltage and a second amplifier amplifying the reference voltage.

In this embodiment, the display panel is a liquid crystal display panel, and the display pixel and sensing pixel are formed by a same process.

Another embodiment is directed to an operating method of a display device which includes a display pixel displaying an image in response to a common voltage and a data voltage and which includes a sensing pixel. The operating method comprises outputting a feedback voltage by supplying a reference voltage to the sensing pixel; generating a counter signal having a counter value that is stepwise varied according to a comparing result of the feedback voltage and the reference voltage; and stepwise varying the common voltage according to the counter value.

In this embodiment, the counter value of the counter signal increases when the feedback voltage is lower in level than the reference voltage, the common voltage increases according to an increase in the counter value, and the feedback voltage increases according to an increase in the common voltage.

In this embodiment, the counter value of the counter signal decreases when the feedback voltage is higher in level than the reference voltage, the common voltage decreases according to a decrease in the counter value, and the feedback voltage decreases according to a decrease in the common voltage.

In this embodiment, the counter value of the counter signal and the common voltage are maintained when a difference between the feedback voltage and the reference voltage exists within a threshold value.

BRIEF DESCRIPTION OF THE DRAWINGS

The above and other features will become more apparent to those of ordinary skill in the art by describing in detail exemplary embodiments thereof with reference to the attached drawings, in which.

DETAILED DESCRIPTION

Example embodiments will now be described more fully hereinafter with reference to the accompanying drawings; however, they may be embodied in different forms and should not be construed as limited to the embodiments set forth herein.

The terminology used herein is for the purpose of describing particular embodiments only and is not intended to be limiting of the embodiments. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Figure 1:
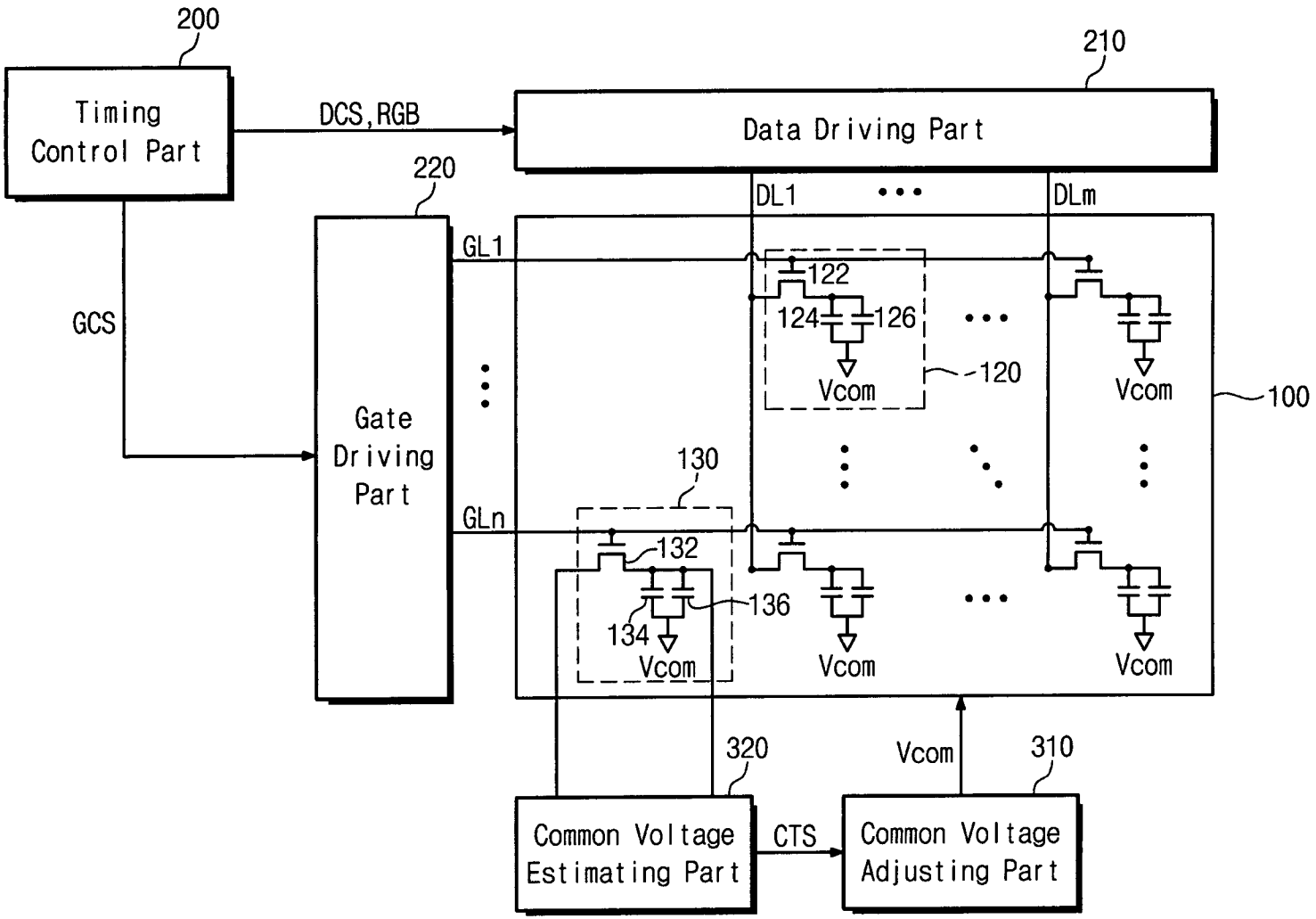
FIG. 1 is a block diagram of a display device according to an exemplary embodiment.

FIG. 1 is a block diagram of a display device according to an exemplary embodiment.

Referring to FIG. 1, a display device may include a display panel 100 and a driving circuit unit for driving the display panel 100. The driving circuit unit may include a timing control part 200, a data driving part 210, a gate driving part 220, a common voltage adjusting part 310, and a common voltage estimating part 320.

The display panel 100 may include display pixels 120 and a sensing pixel 130. The display pixels 120 may be disposed at display areas of the display panel 100. The display pixels 120 may be driven by the driving circuit unit to display an image. The sensing pixel 130 may be disposed at a non-display area of the display panel 100. The sensing pixel 130 may not be used to display an image substantially. In an exemplary embodiment, the display panel 100 may include one sensing pixel 130. In another exemplary embodiment, a plurality of sensing pixels 130 can be provided on the display panel 100.

The display panel 100 may include a plurality of gate lines GL1 to GLn extending in the first direction and a plurality of data lines DL1 to DLm extending to the second direction. Each of the display pixels 120 may be connected with one gate line and one data line. A plurality of display pixels 120 arranged in the first direction may constitute a row, and a plurality of display pixels 120 arranged in the second direction may constitute a column. Display pixels 120 in the same row may be connected with the same gate line, and display pixels 120 in the same column may be connected with the same data line. Each of the gate lines GL1 to GLn may be provided between adjacent rows, and each of the data lines DL1 to DLm may be provided between adjacent columns.

The timing control part 200 may generate a gate control signal GCS and a data control signal DCS. The timing control part 200 may generate the gate control signal GCS to send it to the gate driving part 220. The timing control part 200 may generate the data control signal DCS to send it to the data driving part 210. The timing control part 200 may be configured to a pixel data signal RGB to the data driving part 210.

The data driving part 210 may receive the pixel data signal RGB and the data control signal DCS. The data driving part 210 may convert the pixel data signal RGB into a data output signal to supply it to the data lines DL1 to DLm.

The gate driving part 220 may sequentially apply a gate voltage to the plurality of gate lines GL1 to GLn in response to the gate control signal GCS. In the plurality of gate lines GL1 to GLn, switching elements of display pixels 120 connected with a gate line supplied with the gate voltage may be turned on, while switching elements of display pixels 120 connected with a gate line not supplied with the gate voltage may be turned off Transistors in display pixels 120 connected with the same gate line may be turned on or off at the same time.

Each of the display pixels 120 may include the first transistor 122 connected with a corresponding data line DLi (i=1 to m), the first storage capacitor 124 and the first liquid crystal capacitor 126. The capacitors 124 and 126 may be connected with the first transistor 122.

The first transistor 122 may have a control terminal, an output terminal, and an input terminal. The control terminal may be connected with a corresponding gate line GLj (j=1 to n), the input terminal may be connected with a corresponding data line DLi, and the output terminal may be connected with the first terminal of the first storage capacitor 124 and the first terminal of the first liquid crystal capacitor 126. The second terminal of the first liquid crystal capacitor 126 and the second terminal of the first storage capacitor 124 may be connected to receive a common voltage Vcom.

The sensing pixel 130 may include the second transistor and the second storage capacitor. The second transistor may be formed by the same process as the first transistor 122. The second storage capacitor may be formed by the same process as the first storage capacitor 124.

The sensing pixel 130 may be connected with the common voltage estimating part 320 and the common voltage adjusting part 310. The common voltage adjusting part 310 may supply the display panel 100 with the common voltage Vcom compensating for a kickback voltage. An operating method of the display device according to an exemplary embodiment will be more fully described with reference to FIGS. 2 and 3.

Figure 2:
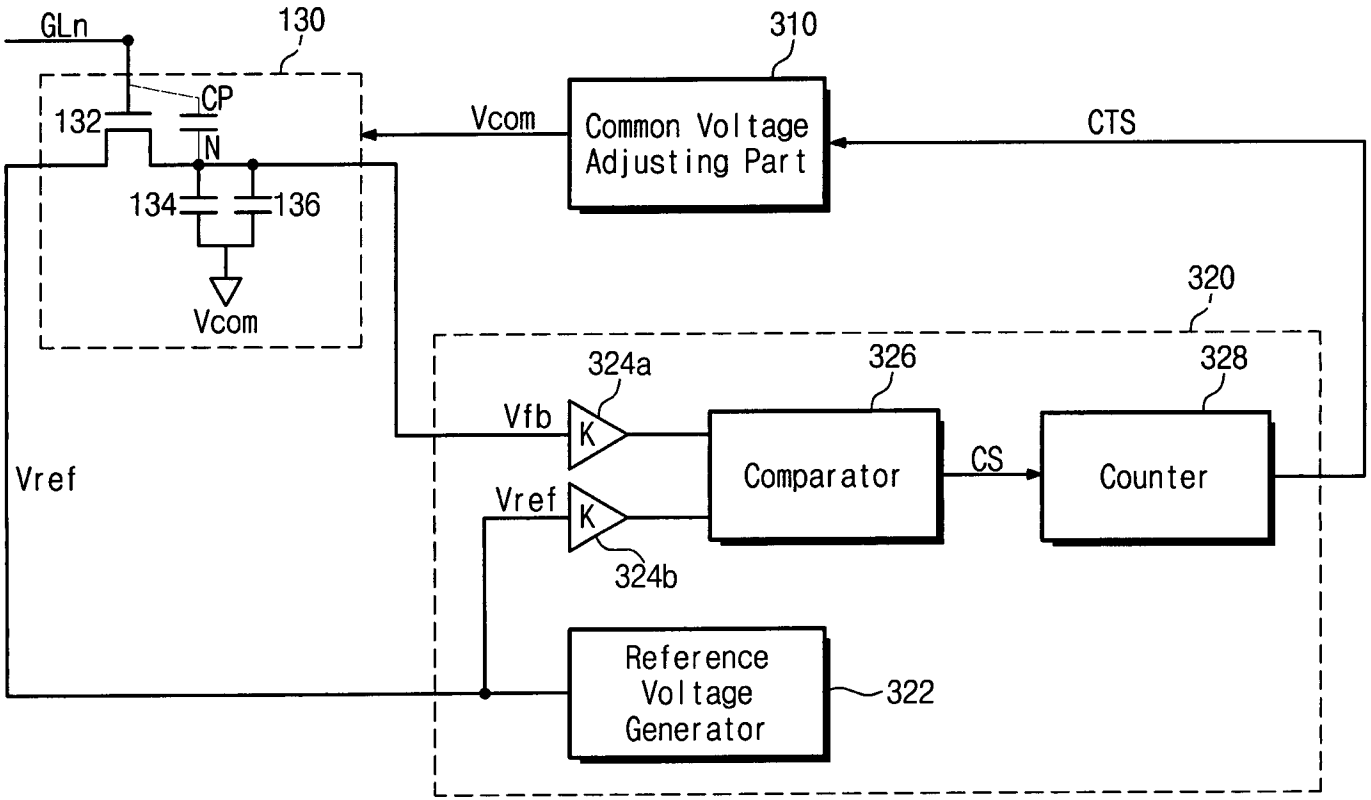
FIG. 2 is a block diagram of a common voltage estimating part according to an exemplary embodiment.
Figure 3:
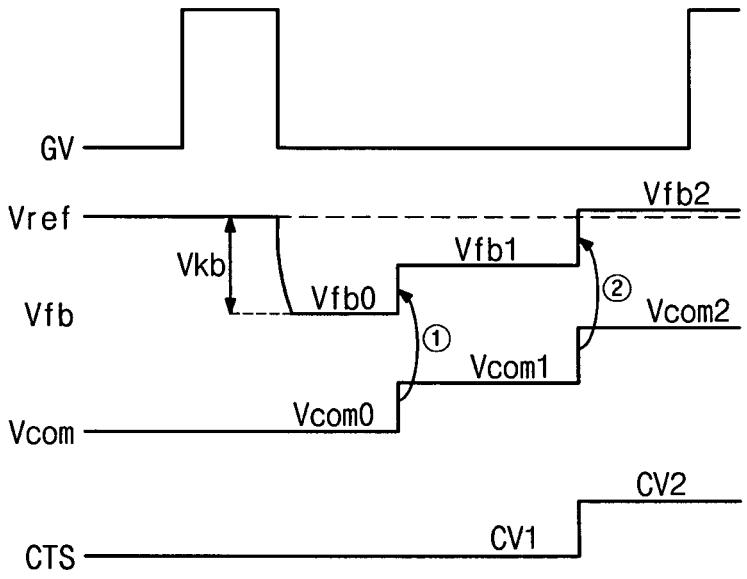
FIG. 3 is a timing diagram for describing an operating method of a display device according to an exemplary embodiment.

FIG. 2 is a block diagram of a common voltage estimating part according to an exemplary embodiment, and FIG. 3 is a timing diagram for describing an operating method of a display device according to an exemplary embodiment.

Referring to FIGS. 2 and 3, a sensing pixel 130 may include the second transistor 132, the second storage capacitor 134 and the second liquid crystal capacitor 136. The common voltage estimating part 320 may include a reference voltage generator 322, the first and second amplifiers 324*a* and 324*b*, a comparator 326, and a counter 328. The reference voltage generator 322 may generate a reference voltage Vref.

The second transistor 132 may have a gate connected with the nth gate line GLn of gate lines GL1 to GLn. In an exemplary embodiment, as sensing pixel transistor, the second transistor 132 may be connected with the nth gate line GLn, but embodiments are not limited to this disclosure. The second transistor 132 may be supplied with a gate voltage GV from a gate driving part 220 in FIG. 1. A parasitic capacitor Cp may exist between the gate of the second transistor 132 and a node N.

The second transistor 132 may have an input terminal connected to receive the reference voltage Vref from the reference voltage generator 322 of the common voltage estimating part 320 and an output terminal connected with the node N.

The first terminal of the second capacitor 134 may be connected with the node N, and the second terminal thereof may be connected to receive an initial common voltage Vcom0 from the common voltage adjusting part 310.

The second transistor 132, the second storage capacitor 134 and the second liquid capacitor 136 may be formed by the same process as the first transistor 122, the first storage capacitor 124 and the first liquid capacitor 126 described in FIG. 1.

The gate voltage GV may have a high level period and a low level period. During the high level period, the second transistor 132 may be turned on. During the low level period, the second transistor 132 may be turned off. The gate voltage GV may transition to a low level from a high level. In this case, the reference voltage Vref applied to the input terminal of the second transistor 132 may not be transferred to its output terminal without a voltage variation, due to the parasitic capacitor Cp between the gate of the second transistor 132 and the node N. In this case, the node N connected with the output terminal of the second transistor 132 may have an initial feedback voltage Vfb0 lower than the reference voltage Vref.

A kickback voltage Vkb may be a difference between the reference voltage Vref and the initial feedback voltage Vfb0. The kickback voltage Vkb may be expressed by the following equation.

$$Vkb = \frac{Cgd}{Clc + Cgd}(Von - Voff)$$

In the equation, Vkb may represent the kickback voltage Vkb, and Cgd may represent a parasitic capacitance between the gate and drain of the sensing pixel transistor 132. Von may represent the gate voltage GV at the high level period, and Voff may represent the gate voltage GV at the low level period.

The initial feedback voltage Vfb0 may be amplified K times by the first amplifier 324*a*, and the amplified initial feedback voltage may be sent to the comparator 326. The reference voltage Vref generated by the reference voltage generator 322 may be amplified K times by the second amplifier 324*b*, and the amplified reference voltage may be transferred to the comparator 326. The comparator 326 may compare the reference voltage Vref thus amplified and the initial feedback voltage Vfbo thus amplified and generate a comparison signal CS as the comparison. The comparison signal CS may include information on a difference between the reference voltage Vref and the initial feedback voltage Vfb0.

The comparison signal CS may be sent to the counter 328. The counter 328 may generate a counter signal CTS having the first counter value CV1 in response to the comparison signal CS. The counter signal CTS having the first counter value CV1 may be sent to the common voltage adjusting part 310.

In the event that the initial feedback voltage Vfb becomes lower than the reference voltage due to the kickback voltage Vkb, the common voltage adjusting part 310 may supply the sensing pixel 130 with the first common voltage Vcom1 higher in level than the initial common voltage Vcom0 in response to the counter signal CTS having the first counter value CV1.

As the common voltage Vcom increases to the first common voltage Vcom1 from the initial common voltage Vcom0, the feedback voltage Vfb may increase to the first feedback voltage Vfb1 from the initial feedback voltage Vfb0 (represented by ① in FIG. 3).

The first feedback voltage Vfb1 may be amplified by the first amplifier 324*a*, and the amplified feedback voltage Vfb1 may be transferred to the comparator 326. The comparator 326 may again generate the comparison signal CS by comparing the amplified feedback voltage and the amplified reference voltage and send it to the counter 328. The counter 328 may stepwise vary a counter value of the counter signal CTS.

For example, if the first feedback voltage Vfb1 is lower in level than the reference voltage Vref, the counter 328 may control the counter value of the counter signal CTS so as to increase to the second counter value CV2 larger than the first counter value CV1. The common voltage adjusting part 310 may supply the sensing pixel 310 with the second common voltage Vcom2 higher in level than the first common voltage Vcom1 in response to the counter signal CTS having the second counter value CV2.

As the common voltage Vcom increases to the second common voltage Vcom2 from the first common voltage Vcom1, the feedback voltage Vfb may increase to the second feedback voltage Vfb2 from the first feedback voltage Vfb1 (represented by ② in FIG. 3).

The second feedback voltage Vfb2 may be amplified by the first amplifier 324*a*, and the amplified feedback voltage Vfb2 may be transferred to the comparator 326. The comparator 326 may again generate the comparison signal CS by comparing the amplified feedback voltage and the amplified reference voltage and send it to the counter 328. The counter 328 may stepwise vary a counter value of the counter signal CTS or maintain it.

For example, if a difference between the second feedback voltage Vfb2 and the reference voltage Vref is within a threshold value, the counter value of the counter signal CTS may be maintained with the second counter value CV2. In an exemplary embodiment, the threshold voltage may be about 20 mV.

The counter signal CTS having the second counter value CV2 may be supplied to the common voltage adjusting part 310. At this time, the common voltage adjusting part 310 may supply a display panel 100 including display pixels in FIG. 1 with the second common voltage Vcom2 in response to the counter signal CTS having the second counter value CV2.

According to an exemplary embodiment, a common voltage Vcom may increase according to a counter value of the counter signal CTS, and a feedback voltage Vfb may increase according to an increase in the common voltage Vcom. In this case, a common voltage Vcom may be supplied to compensate for the kickback voltage Vkb. This means that quality lowering due to the kickback voltage Vkb can be minimized. Accordingly, it is possible to provide a display device having the high reliability.

Unlike the above embodiment, in a case where the feedback voltage Vfb is higher in level than the reference voltage Vref, the feedback voltage Vfb may decrease to have a voltage level between the reference voltage Vref and the threshold value. An operating method of a display device according to an exemplary embodiment will be more fully described with reference to FIG. 4.

Figure 4:
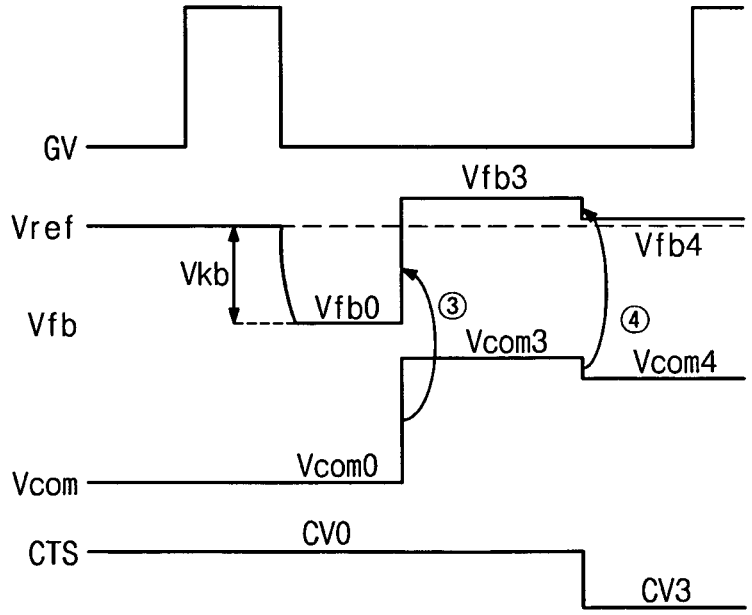
FIG. 4 is a diagram for describing an operating method of a display device according to another exemplary embodiment.

FIG. 4 is a diagram for describing an operating method of a display device according to another exemplary embodiment.

Referring to FIGS. 2 and 4, a display device may be provided which includes a sensing pixel 130, a common voltage adjusting part 310, and a common voltage estimating part 320. When a reference voltage Vref is supplied to the sensing pixel 130, a node N in FIG. 2 may have an initial feedback voltage Vfb0. That is, an initial common voltage Vcom0 may be applied to the first terminal of the second storage capacitor 134 and the first terminal of the second liquid crystal capacitor 136.

A counter signal CTS of a counter 328 may have an initial counter value CV0. The counter signal CTS having the initial counter value CV0 may be sent to the common voltage adjusting part 310. The common voltage adjusting part 310 may supply the sensing pixel 130 with the third common voltage Vcom3 higher in level than the initial common voltage Vcom0 in response to the counter signal CTS having the initial counter value CV0.

The feedback voltage Vfb may increase to the third feedback voltage Vfb3 from the initial feedback voltage Vfb0 as the common voltage Vcom increases to the third common voltage Vcom3 from the initial common voltage Vcom0 (represented by ③ in FIG. 4).

The third feedback voltage Vfb3 may be amplified by the first amplifier 324*a*, and the amplified feedback voltage may be sent to the comparator 326. The comparator 326 may generate a comparison signal CS by comparing the amplified third feedback voltage and the amplified reference voltage. The comparison signal CS may be transferred to the counter 328. The comparison signal CS may include information on a difference between the reference voltage Vref and the third feedback voltage Vfb3.

The counter 328 may stepwise vary a counter value of the counter signal CTS in response to the comparison signal CS. For example, if the third feedback voltage Vfb3 is higher in level than the reference voltage Vref, the counter 328 may control the counter value of the counter signal CTS so as to decrease to the third counter value CV3 less than the initial counter value CV0.

The common voltage adjusting part 310 may supply the sensing pixel 130 with the fourth common voltage Vcom4 lower in level than the third common voltage Vcom3 in response to the counter signal CTS having the third counter value CV3. As the common voltage Vcom decreases to the fourth common voltage from the third common voltage Vcom3, the feedback voltage Vfb may decrease to the fourth feedback voltage Vfb4 from the third feedback voltage Vfb3 (represented by ④ in FIG. 4).

The fourth feedback voltage Vfb4 may be amplified by the first amplifier 324*a*, and the amplified fourth feedback voltage Vfb4 may be transferred to the comparator 326. The comparator 326 may again generate the comparison signal CS by comparing the amplified fourth feedback voltage and the amplified reference voltage and send it to the counter 328. The counter 328 may stepwise vary a counter value of the counter signal CTS in response to the comparison signal CS or maintain it. For example, if a difference between the fourth feedback and the reference voltage Vref exists within a threshold value, the counter value of the counter signal CTS may be maintained at the third counter value CV3.

The counter signal CTS having the third counter value CV3 may be supplied to the common voltage adjusting part 310. At this time, the common voltage adjusting part 310 may supply a display panel 100 including display pixels in FIG. 1 with the fourth common voltage Vcom4 in response to the counter signal CTS.

Below, an operating method of a display device according to still another exemplary embodiment will be more fully described.

Figure 5:
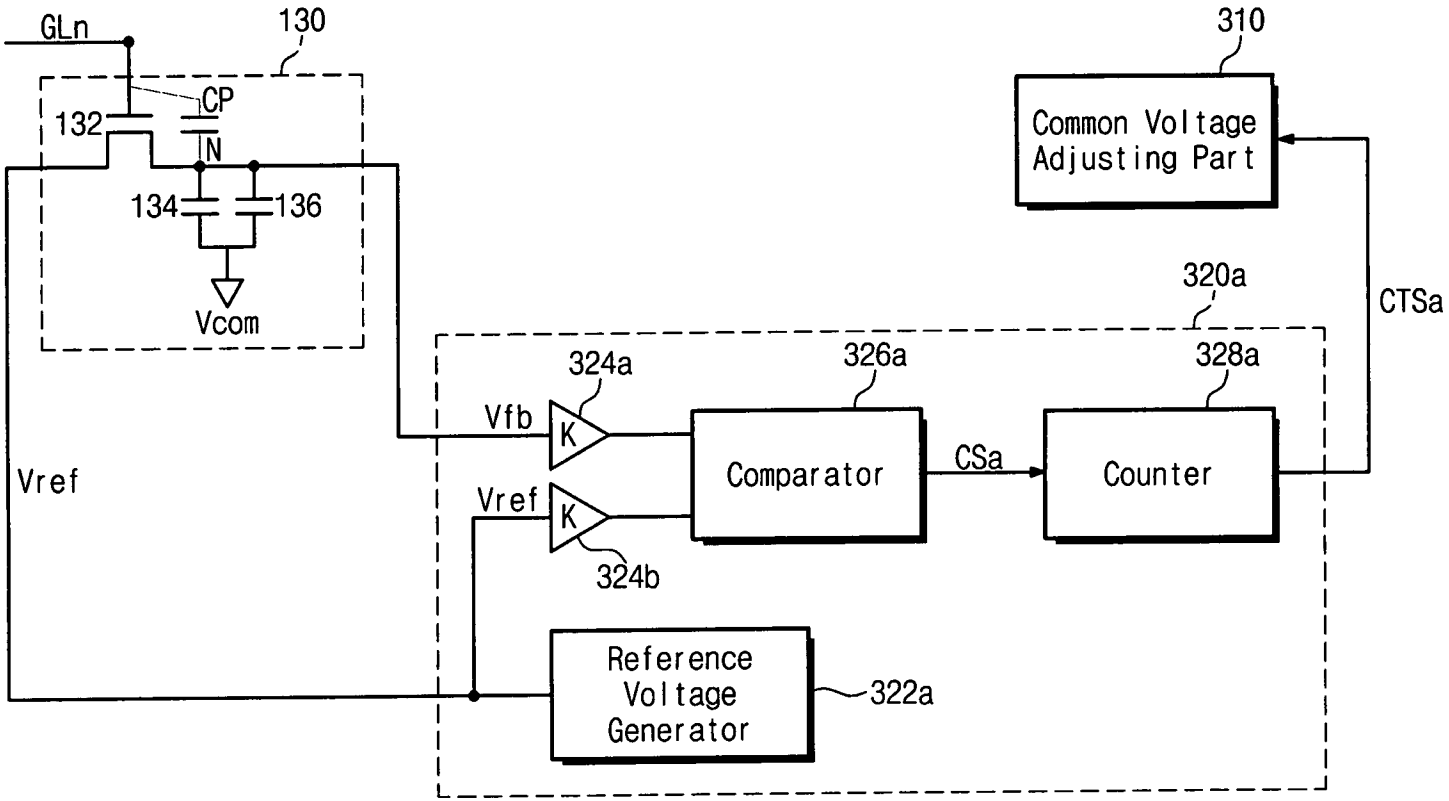
FIG. 5 is a diagram for describing an operating method of a display device according to still another exemplary embodiment.

FIG. 5 is a diagram for describing an operating method of a display device according to still another exemplary embodiment.

Referring to FIG. 5, a sensing pixel may be provided which includes the second transistor 132, the second capacitor 134 and the second liquid crystal capacitor 136. A common voltage estimating part 320*a* may include a reference voltage generator 322 for generating a reference voltage Vref, the first and second amplifiers 324*a* and 324*b*, a comparator 326*a*, and a counter 328*a*.

A feedback voltage Vb reduced due to a kickback voltage may be applied to a node N of the sensing pixel 130. The feedback voltage Vfb may be amplified K times by the first amplifier 324*a* and the amplified feedback voltage may be sent to the comparator 326*a*. The reference voltage Vref generated by the reference voltage generator 322 may be amplified K times, and the amplified reference voltage may be transferred to the comparator 326*a*. The comparator 326*a* may generate a comparison signal CSa by comparing the amplified reference signal Vref and the amplified feedback voltage Vfb. The comparison signal CSa may include information on a difference between the reference voltage Vref and the feedback voltage Vfb.

The comparison signal CSa may be sent to the counter 328*a*. The counter 328*a* may generate a counter signal CTSa having a counter value in response to the comparison signal CSa. For example, the more a difference between the reference voltage Vref and the feedback voltage Vfb, the more a counter value of the counter signal CTSa. The counter signal CTSa having the counter value may be sent to the common voltage adjusting part 310.

The common voltage adjusting part 310 may supply a display panel 100 including display pixels 120 in FIG. 1 with a common voltage Vcom in response to the counter signal CTSa having the counter value. For example, as the counter value of the counter signal CTSa increases, the common voltage adjusting part 310 may supply the display panel 100 with the common voltage having a relatively high level. Accordingly, the high reliability of a display device may be provided by compensating for the kickback voltage.

Below, an operating method of a display device according to still another exemplary embodiment will be more fully described.

Figure 6:
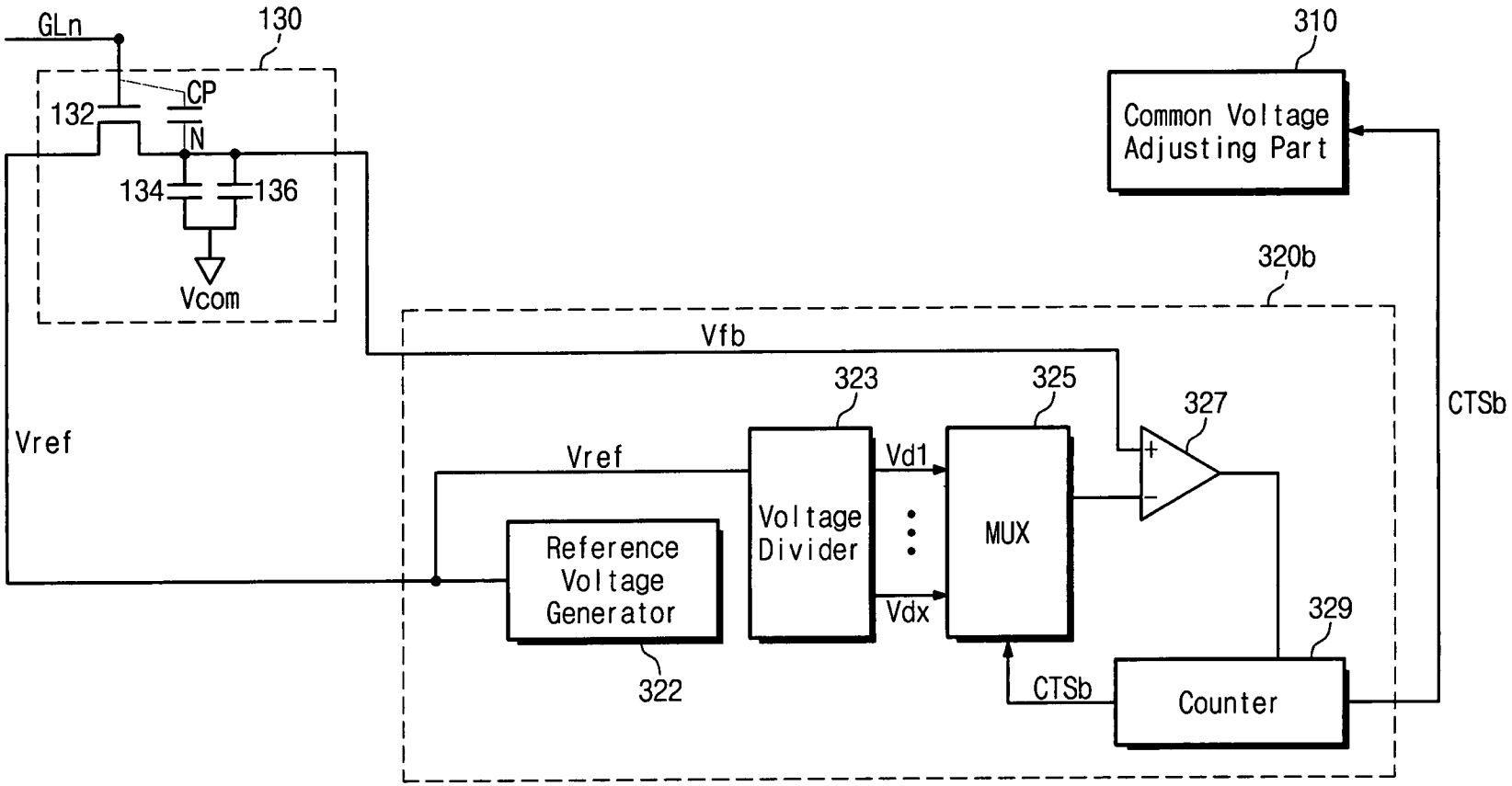
FIG. 6 is a diagram for describing an operating method of a display device according to still another exemplary embodiment.

FIG. 6 is a diagram for describing an operating method of a display device according to still another exemplary embodiment.

Referring to FIG. 6, a sensing pixel 130 may be provided which includes a second transistor 132, the second capacitor 134 and the second liquid crystal capacitor 136 described with reference to FIG. 2. A common voltage estimating part 320*b* may include a reference voltage generator 322 for generating a reference voltage Vref, a voltage divider 323, a multiplexer 325, a differential amplifier 327, and a counter 328*b*.

The reference voltage Vref generated by the reference voltage generator 322 may be applied to the voltage divider 323. The voltage divider 323 may divide the reference voltage Vref to generate a plurality of division voltages Vd1 to Vdx. The division voltages Vd1 to Vdx may be generated to have voltage levels different to one another. The division voltages Vd1 to Vdx may be transferred to the multiplexer 325.

The multiplexer 325 may select one of the division voltages Vd1 to Vdx in response to a counter signal CTSb having a counter value from the counter 329, and the selected division voltage may be applied to the differential amplifier 327. When applied to a node N of the sensing pixel 130, the feedback voltage Vfb may be transferred to the differential amplifier 327. The feedback voltage Vfb may become lower than the reference voltage Vref due to a kickback voltage.

The differential amplifier 327 may transfer a difference between the feedback voltage Vfb and a division voltage from the multiplexer 325 to the counter 329. In response to the difference from the differential amplifier, the counter 329 may stepwise vary the counter value of the counter signal CTSb or maintain it.

For example, in the event that a division voltage Vd1 lower in level than the reference voltage Vref is applied to the differential amplifier 327, the counter 329 may increase the counter value of the counter signal CTSb. In this case, in response to the counter signal CTSb having the increased counter value, the multiplexer 325 may supply the differential amplifier 327 with a division voltage Vd2 higher than the division voltage Vd1.

The differential amplifier 327 may transfer a difference between the reference voltage Vref and the division voltage Vd2 to the counter 329. For example, if a difference between the reference voltage Vref and the division voltage Vd2 exists within a threshold value, the counter 329 may maintain the counter value of the counter signal CTSb. In this case, the counter signal CTSb having the counter value may be sent to the common voltage adjusting part 310. The common voltage adjusting part 310 may supply the display panel 100 with the common voltage Vcom compensating for the kickback voltage.

By way of summation and review, a gray voltage may decrease by a constant voltage when a gate voltage of a thin film transistor for driving a liquid crystal switches to a gate off voltage from a gate on voltage. At this time, the decreased voltage may be called a kickback voltage.

Such a situation is circumvented with the exemplary embodiments. In particular, with the exemplary embodiments, a driving circuit unit for driving a display panel may generate a counter signal by applying a reference voltage to a sensing pixel of a display panel and comparing a feedback voltage of the sensing pixel with the reference voltage. The driving circuit unit may adjust a common voltage in response to the counter signal such that the feedback voltage becomes identical to the reference voltage. In this case, the high reliability of a display panel may be provided by reducing a quality lowering due to the kickback voltage. Further, it is possible to reduce a flicker phenomenon.

Exemplary embodiments have been disclosed herein, and although specific terms are employed, they are used and are to be interpreted in a generic and descriptive sense only and not for purpose of limitation.

What is claimed is:

1. A display device, comprising:

a display panel including a display pixel displaying an image in response to a common voltage and a data voltage and a sensing pixel outputting a feedback voltage in response to the common voltage and a reference voltage; and a driving circuit unit supplying the data voltage and the reference voltage to the display pixel and the sensing pixel, respectively, wherein the driving circuit unit includes:

a common voltage estimating part comparing the reference voltage and the feedback voltage to generate a counter signal having a counter value that is stepwise varied according to the comparing of the reference voltage and the feedback voltage; and a common voltage adjusting part stepwise varying the common voltage supplied to the display panel in response to the counter value, wherein the driving circuit unit generates the data voltage independently from the varied common voltage, and wherein the sensing pixel is not coupled to a data line.

2. The display device as claimed in claim 1, wherein the common voltage estimating part includes:

a reference voltage generator generating the reference voltage and applying the reference voltage to the sensing pixel;

a comparator generating a comparison signal by comparing the reference voltage and the feedback voltage; and a counter generating the counter signal having the counter value in response to the comparison signal.

3. The display device as claimed in claim 2, wherein when the feedback voltage is lower in level than the reference voltage:

the counter increases the counter value of the counter signal in response to the comparison signal, and the common voltage adjusting part increases the common voltage in response to the counter signal increasing the counter value.

4. The display device as claimed in claim 2, wherein when the feedback voltage is higher in level than the reference voltage:

the counter decreases the counter value of the counter signal in response to the comparison signal, and the common voltage adjusting part decreases the common voltage in response to the counter signal decreasing the counter value.

5. The display device as claimed in claim 2, wherein the counter maintains the counter value of the counter signal when a difference between the reference voltage and the feedback voltage exists within a threshold value.

6. The display device as claimed in claim 2, wherein:

the counter signal has an initial counter value, the counter signal having the initial counter value is supplied to the common voltage adjusting part before the comparison signal is generated by the comparator, and the common voltage adjusting part increases the common voltage in response to the counter signal having the initial counter value.

7. The display device as claimed in claim 1, wherein the driving circuit unit further includes a gate driving part supplying a gate voltage to the display pixel and sensing pixel.

8. The display device as claimed in claim 6, wherein the counter varies the counter value in a stepwise manner during a low level period of a gate voltage.

9. The display device as claimed in claim 1, wherein the common voltage adjusting part further includes a first amplifier amplifying the feedback voltage and a second amplifier amplifying the reference voltage.

10. The display device as claimed in claim 1, wherein the display panel is a liquid crystal display panel, and the display pixel and sensing pixel are formed by a same process.

11. The display device as claimed in claim 1, wherein the sensing pixel is in a non-display area.

12. An operating method of a display device which includes a display pixel displaying an image in response to a common voltage and a data voltage and which includes a sensing pixel, the operating method comprising:

outputting a feedback voltage by supplying a reference voltage to the sensing pixel, wherein the sensing pixel is not coupled to a data line;

generating a counter signal having a counter value that is stepwise varied according to a comparing result of the feedback voltage and the reference voltage;

stepwise varying the common voltage according to the counter value; and outputting the varied common voltage to the display pixel.

13. The operating method as claimed in claim 12, wherein:

the counter value of the counter signal increases when the feedback voltage is lower in level than the reference voltage, the common voltage increases according to an increase in the counter value, and the feedback voltage increases according to an increase in the common voltage.

14. The operating method as claimed in claim 12, wherein:

the counter value of the counter signal decreases when the feedback voltage is higher in level than the reference voltage, the common voltage decreases according to a decrease in the counter value, and the feedback voltage decreases according to a decrease in the common voltage.

15. The operating method as claimed in claim 12, wherein the counter value of the counter signal and the common voltage are maintained when a difference between the feedback voltage and the reference voltage exists within a threshold value.

16. An apparatus, comprising:

a comparator to compare a feedback voltage from a sensing pixel and a reference voltage; and an adjuster to vary a common voltage based on the comparison, wherein the adjuster is to output the varied common voltage to pixels of a display panel independently from data output from a data driver, wherein the sensing pixel is not coupled to a data line.

17. The apparatus as claimed in claim 16, wherein the adjuster is to increase the common voltage when the feedback voltage is less than the reference voltage.

18. The apparatus as claimed in claim 16, wherein the adjuster is to decrease the common voltage when the feedback voltage is greater than the reference voltage.

* * * * *